United States Patent [19]

Henderson

[11] 4,449,351

[45] May 22, 1984

[54] BLISTER PACK LOADING MACHINE

[75] Inventor: Matthew P. Henderson, East Rochester, N.Y.

[73] Assignee: Pennwalt Corporation, Philadelphia, Pa.

[21] Appl. No.: 276,100

[22] Filed: Jun. 22, 1981

[51] Int. Cl.[3] ..... B65B 43/38

[52] U.S. Cl. ..... 53/569; 53/266 A; 53/382

[58] Field of Search ..... 53/569, 468, 209, 382, 53/266 R, 266 A, 266 C, 394, 395, 50; 493/915

[56] References Cited

U.S. PATENT DOCUMENTS

| | | | |
|---|---|---|---|
| 1,086,391 | 2/1914 | Molyneux | 53/569 X |
| 1,272,510 | 7/1918 | Paridon | 53/394 |
| 1,960,959 | 5/1934 | Sague | 53/569 X |
| 2,501,626 | 3/1950 | Wright | 53/394 |
| 3,030,752 | 4/1962 | De Woskin | 53/266 |
| 3,382,126 | 5/1968 | Hackmann | 53/266 A |
| 3,807,121 | 4/1974 | Mundt et al. | 53/266 C |

*Primary Examiner*—James F. Coan

[57] ABSTRACT

Production machine which automatically rapidly continuously heat-seals blister packs of pharmaceutical capsules into match book-like covers coated on interior surfaces with a heat-sealing composition and provided on outer surfaces with descriptive printed material. The machine deposits these covers in a folded condition onto flights spaced uniformly transversely across an endless conveyor chain, opens the folded covers in order to receive the blister packs between sealing flaps and back covers of the match book-like covers, heat seals the blister packs therebetween, and then folds front covers thereover prior to packaging. Several operations are necessarily synchronized with continuous stop-and-go movement of the chain by means of cams, linkages, and pivoting members.

22 Claims, 12 Drawing Figures

BLISTER PACK LOADING MACHINE

STATEMENT OF THE INVENTION

This invention relates to a loading machine and more particularly to a machine which rapidly automatically continuously loads blister-type packages of small articles such as pharmaceutical capsules into match book-like covers.

BACKGROUND AND SUMMARY OF THE INVENTION

Blister packaging of small articles such as pills, tablets and capsules is well known. The blister pack typically comprises a blister sheet of clear plastic having bubbles or cavities formed therein, each containing one or more of the small articles. A foil sheet of frangible or rupturable material, suitably aluminum, is attached to the blister sheet by conventional methods. The pill, tablet, or capsule may be removed from the blister compartment by any one of several known means.

In order to enhance the marketing appeal of these blister packs, and to provide a medium for receiving certain necessary printed information thereon regarding contents of the blister packs and the source of the contents, covers or other packaging means are desirably attached to or folded over each blister pack. A pharmaceutical blister pack, for example, may contain one or two capsules in a small blister package measuring about 1¾" square. A match book-like cover, suitably about 2½" square, hereinafter referred to as a match book cover, is ideally adapted to receive the necessary printed information on both sides of the cover flaps and yet provide the desired merchandising appeal.

Heretofore, such pharmaceutical blister packs were inserted manually into match book covers and suitably affixed therein, or by semi-automatic machinery which loaded the blister packs into the match book covers at a rate considered slow for profitable commercial applications.

Briefly, the present loading machine receives the folded printed match book covers on an endless conveyor chain, opens the front cover and separates the short sealing flap from the back cover, deposits the pre-filled blister packs between the sealing flap and back cover, heat and pressure seals the blister pack between the sealing flap and back cover, folds the front cover over the sealed blister pack, and packages the loaded match book covers into suitable boxes. The machine is reliable, rapid loading, and capable of continuous loading from either side or simultaneously from both sides. Safety features may readily be incorporated into the machine to stop it if the match book covers are not properly opened or bent, if the blister packs are improperly inserted within the match book covers, and the like.

DETAILED DESCRIPTION OF THE DRAWINGS

Figure 1:
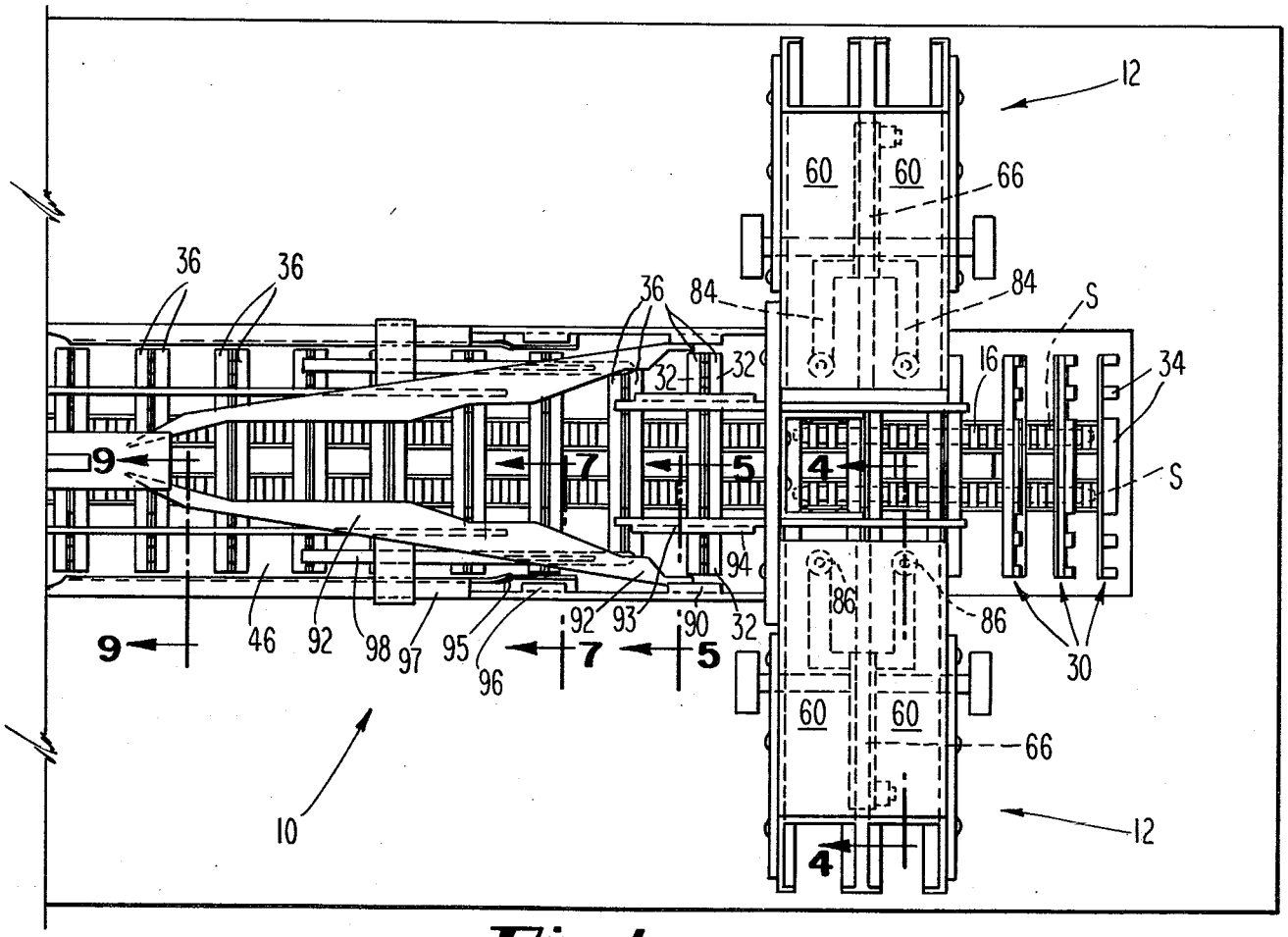
FIGS. 1 and 2 form a plan view of the loading machine of the present invention.

In FIG. 1, loading machine 10 includes a pair of angularly disposed feeder chutes 12 which feed folded match book covers 14 (FIG. 3A) onto an endless conveyor chain 16. Movement of chain 16 is best characterized as continuous stop-and-go. Thus, chain 16 remains stationary as each of the chutes 12 simultaneously deposits 2 folded match book covers 14 onto chain 16 in tandem, each of the pairs of tandem deposited match book covers being further disposed in side-by-side arrangement. Match book covers 14 are then transported by chain 16 to succeeding stations where the covers are successively opened to thereby be in position to receive filled blister packs 20 of capsules from blister pack magazines 22. Heat and pressure sealing jaws 26 seal the filled blister packs 20 between the short sealing flaps of match book covers 14 and the back covers. The filled match book covers are then folded or closed prior to packaging in boxes. It is understood, of course, the entire chain momentarily stops each time the empty folded match book covers 14 are deposited thereon. The depositing operation is synchronized with the heat and pressure sealing operation, later described.

Chutes 12 and magazines 22 are supported by suitable bracket members mounted on the frame of machine 10. The frame houses structure to be discussed hereinafter for providing the synchronization above-referred to as well as other structure necessary for the operation of the machine.

Figure 5:
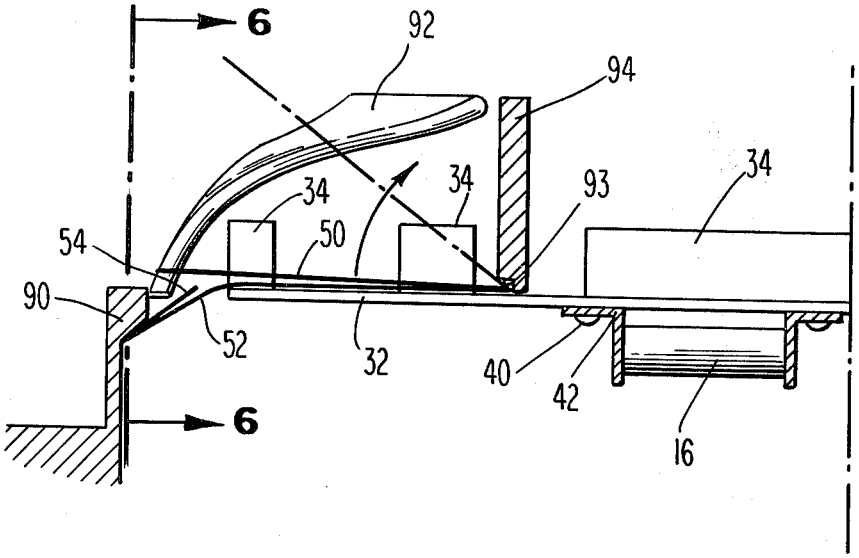
Figure 6:
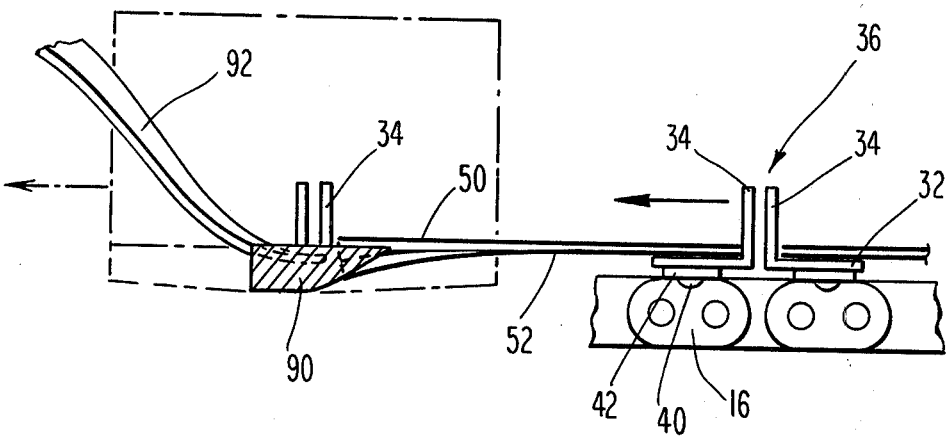
FIG. 6 is a sectional view of the structure of FIG. 5 taken along line 6-6 thereof.

Endless chain 16, suitably a pair of closely spaced chains, in parallel, and moving in unison, is mounted to and rotated by sprockets S (FIGS. 1 and 2) driven by a suitable motor M. Chain 16 carries a plurality of flights 30 secured transversely thereacross. A flight 30 comprises a horizontal strip 32, shown clearly in FIGS. 5 and 6, integral with a vertical portion 34. Flight 30 are arranged in pairs 36 such that vertical portions 34 of two adjacent flights are in spaced back to back relationships, each flight 30 being individually secured to chain 16 by means of screws 40 engaging individual chain link flanges 42. Flight pairs 36 are not secured together since the distance between individual flights 30 of flight pairs 36 do not remain constant when traveling around the sprockets S. Flight pairs 36 are spaced uniformly on chain 16 such that the distance between the adjacent flights pairs 36 is sufficient to accommodate a match book cover 14 along its width dimension when the match book cover is deposited between horizontal strips 32 of adjacent flight pairs 36.

Ends of flight 30 extend beyond chain 16 and are partially supported on and slide along teflon slide strips 46 secured to machine 10.

A match book cover 14 comprises a front cover 50, back cover 52, and a narrow sealing flap 54. Inner surfaces of sealing flap 54 and back cover 52 are coated with a suitable heat sealing composition, such, for example, as a modified vinyl resin, or, for reasons of economy or convenience, the entire inner surfaces of match book covers 14 may be so coated.

Figure 4:
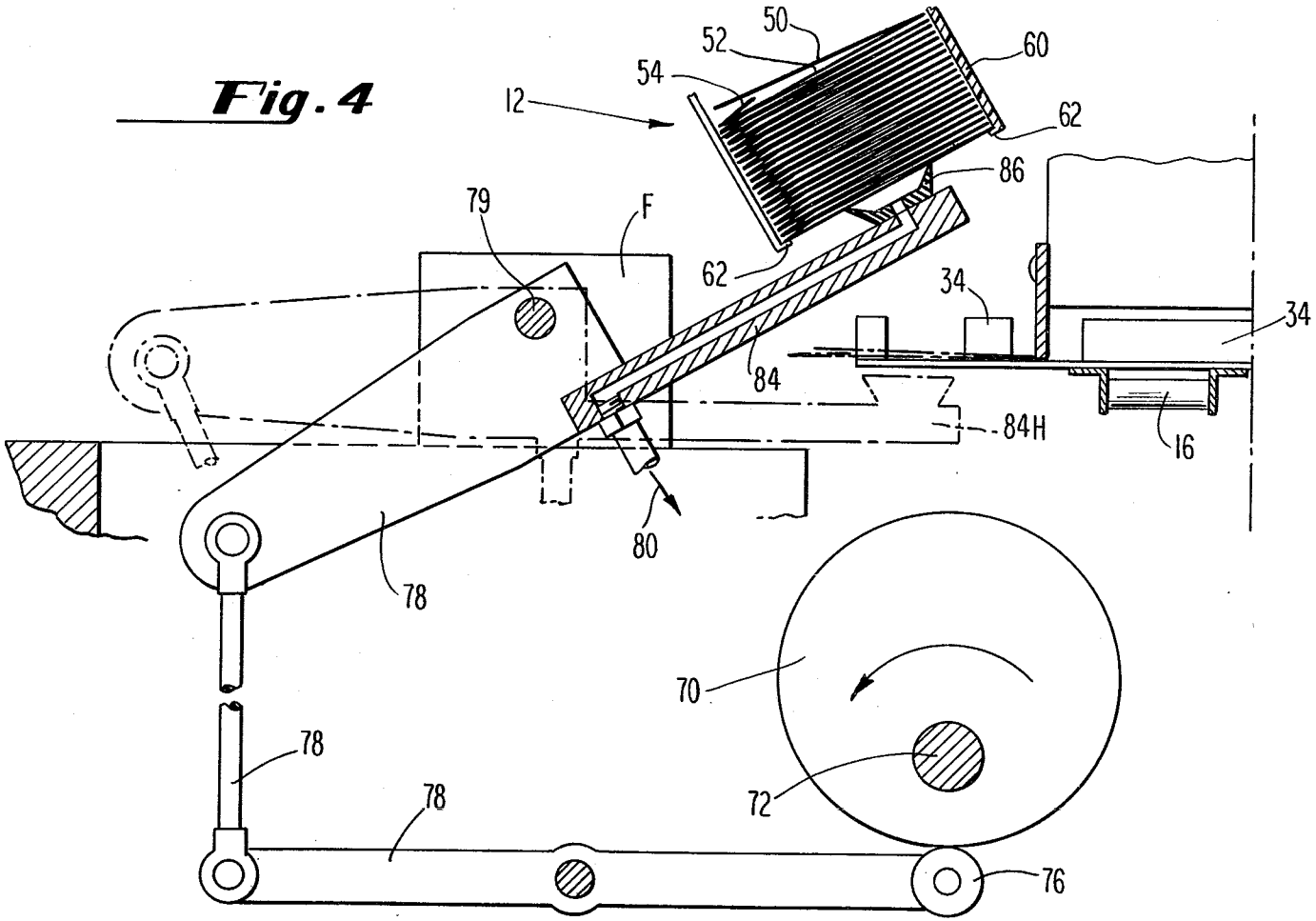
FIGS. 4 and 5 are sectional views of the machine of FIG. 1 taken respectively along lines 4-4 and 5-5 thereof.

Folded coated match book covers 14 are loaded into chutes 12 with their front covers 50 disposed uppermost and sealing flaps 54 facing upwardly and toward the other chute 12 (FIG. 4). Each chute 12 is provided with a pair of adjoining identical feed chambers 60, tandem disposed, such that each time chain 16 is caused to stop, a pair of match book covers 14 is simultaneously tandem deposited by each chute onto horizontal strips 32 of adjacent flight pair 36, each match book cover 14 of opposing pairs of match book covers being deposited in side-by-side relationship.

Loading machine 10 is designed and adapted to function with matchbook covers 14 fed from either chute 12 onto the flights, or both chutes simutaneously to thereby double production. Since each side of loading machine 10 is substantially a mirror image of the other (FIGS. 1 and 2), description of only one side of the machine will proceed hereinafter, it being understood that similar operations may be simultaneously performed by similar structure on the other side of the machine.

Chambers 60 are provided with a narrow lip 62 at a lower most portion thereof for retaining the match book covers within the chambers when not being deposited onto the flights. When it is desired however to deposit the match book covers, a U-shaped pivot suction arm 66 (FIG. 1) withdraws a match book cover simultaneously from each of chambers 60 to deposit the pair of match book covers onto the flights. More specifically, a cam member 70 (FIG. 4) is secured to a cam shaft 72 rotated by motor M. A cam follower 76 responsive to rotation of cam 70, articulates with linkage members 78 one of which is connected to the U-shaped pivot suction arm 66. Arm 66 is connected to a flexible vacuum line 80, which communicates with a vacuum pump (not shown). Linkage member 78 is pivotally mounted to frame member F at 79.

Each leg 84 of pivot suction arm 66 is provided with a suction cup 86. Legs 84 are designed to pass between adjacent flight pairs 36 when pivoted such that each suction cup 86 withdraws a match book cover from each chamber 60. As cam 70 continues to rotate, linkage members 78 cause U-shaped arm 66 to return to its home position 84H, i.e., to pivot downwardly carrying therewith a match book cover 14 on each cup 86 until the match book covers contact horizontal strips 32 of adjacent flight pairs 36 which capture the match book covers thereon. Approximately simultaneously therewith, suction is removed from vacuum line 80. Of course, chain 16 is stationary while suction arm 66 is pivoting upwardly and downwardly. More specifically, motor M rotates cam shaft 72 continuously as aforementioned, and also drives chain 16 intermittently, through sprockets S, by means of a commercially available intermittent motion drive. Each 360° revolution of cam shaft 72 represents one complete cycle of the machine. Chain 16 remains stationary for each 180° of revolution of cam shaft 72 and advances a specified distance during the other 180° of revolution. Cam 70 is provided with a no-actuation dwell which coincides with the 180° revolution of cam shaft 72 during which chain 16 is advancing. The slope on cam 70 which produces the desired motions aforediscussed occupy substantially all of the remaining 180° thereon, i.e., when chain 16 is stationary.

Immediately after the match book covers are captured between adjacent flight pairs on horizontal strips 32 substantially over the teflon slide strip 46, chain 16 advances all flights 30 a predetermined distance to thereby enable pivot suction arm 66 to repeat its motion of depositing another pair of match book covers immediately behind the preceeding deposited pair.

Meanwhile, the first or leading match book cover of the already deposited pair of match book covers encounters deflector 90 (FIGS. 1, 3B, 5 and 6) which causes the leading edge of the match book cover at the sealing flap end thereof to bend or deflect downwardly to thus permit a ramp 92, immediately downstream of said deflector 90, to slide under the front cover 50 to gradually open or unfold it as the match book cover is transported downstream. Of course, the second match book cover of the already deposited pair, and others to follow, is then subjected to the identical operation. In order to prevent the other end of match book cover 14 from springing upwardly when the sealing flap end encounters deflector 90, a notch 93 is provided in a hold-down bar 94 (FIG. 5) to restrain such upward movement.

Figure 3:
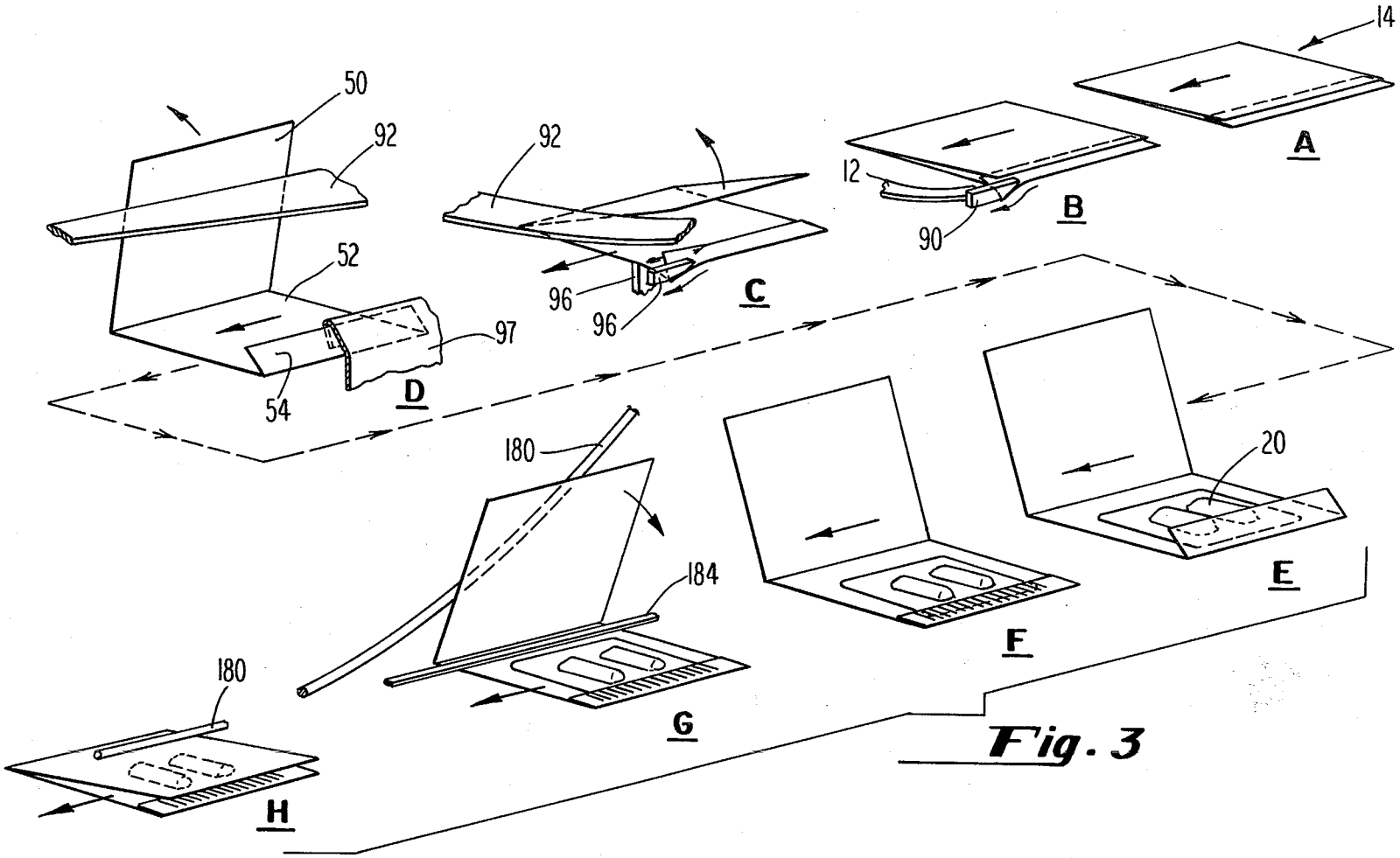
FIG. 3 diagramatically illustrates the process steps employed in the loading of a match book cover by the automatic loading machine of the present invention.
Figure 7:
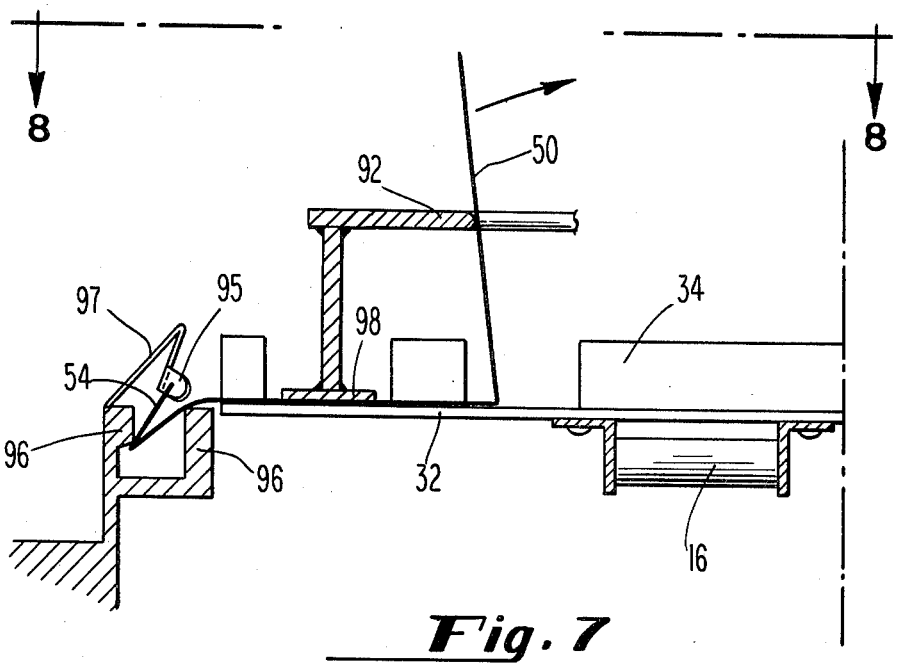
FIG. 7 is a sectional view of the machine of FIG. 1 taken along line 7-7 thereof.
Figure 8:
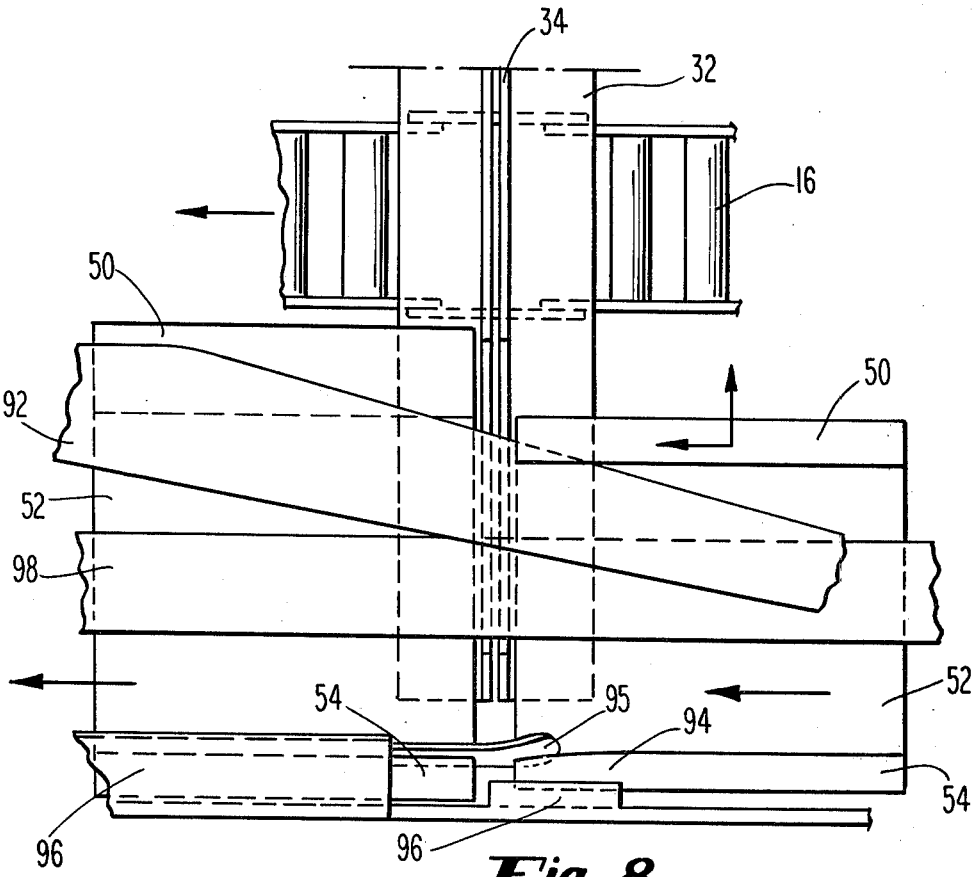
FIG. 8 is a plan view of the structure illustrated in FIG. 7 looking in the direction indicated by arrows 8-8.
Figure 9:
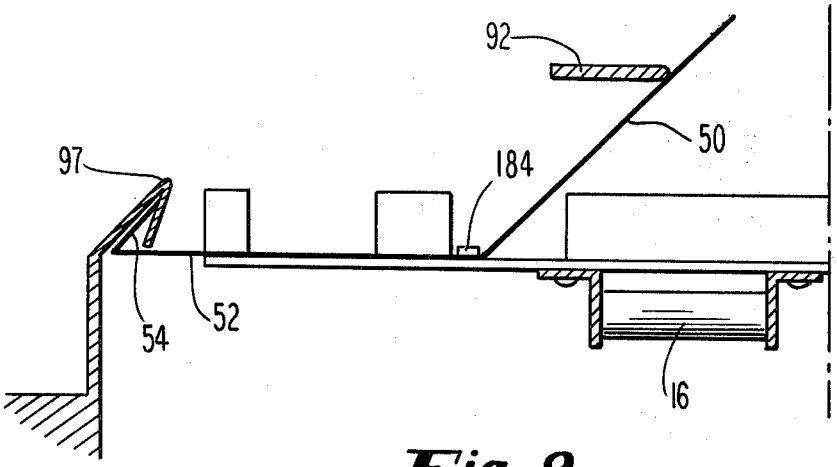
FIG. 9 and FIGS. 10 and 11 are sectional views of the machine of FIGS. 1 and 2 respectively taken along lines 9-9, 10-10, and 11-11.
Figure 11:
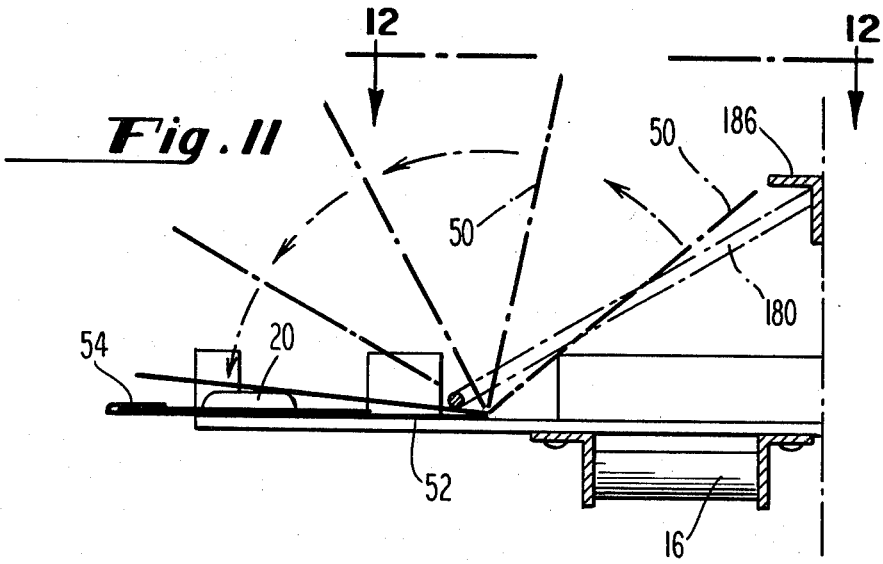
Figure 12:
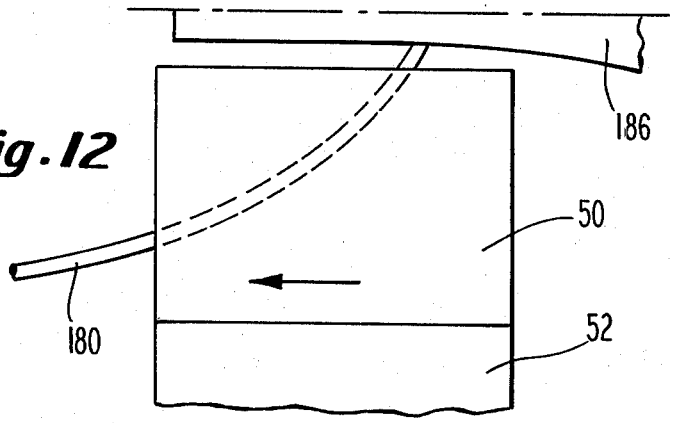
FIG. 12 is a plan view of a portion of the structure illustrated in FIG. 11 indicated by arrows 12-12.

Proceeding further downstream, the match book cover contacts a depressor plate 95 (FIGS. 1, 7 and 8) which urges the sealing flap end downwardly over depressor member 96, shown clearly in FIG. 7 and FIG. 3C. The sealing flap of the match book cover is then captured within a sealing flap guide rail 97 (FIG. 3D) which opens the sealing flap in order that a blister pack 20 may be inserted thereagainst (FIG. 3E). A back cover hold down bar 98 (FIGS. 7 and 8) attached to ramp 92 maintains back cover 52 in a substantially horizontal position while the sealing flap end is depressed and front cover 50 is being progressively opened by ramp 92 (FIG. 9).

Filled blister packs 20 are inserted upside-down (FIG. 10) into the blister pack magazines 22 vertically disposed above the open match book covers. Each magazine 22 includes dual blister pack compartments (FIG. 2).

Figure 10:
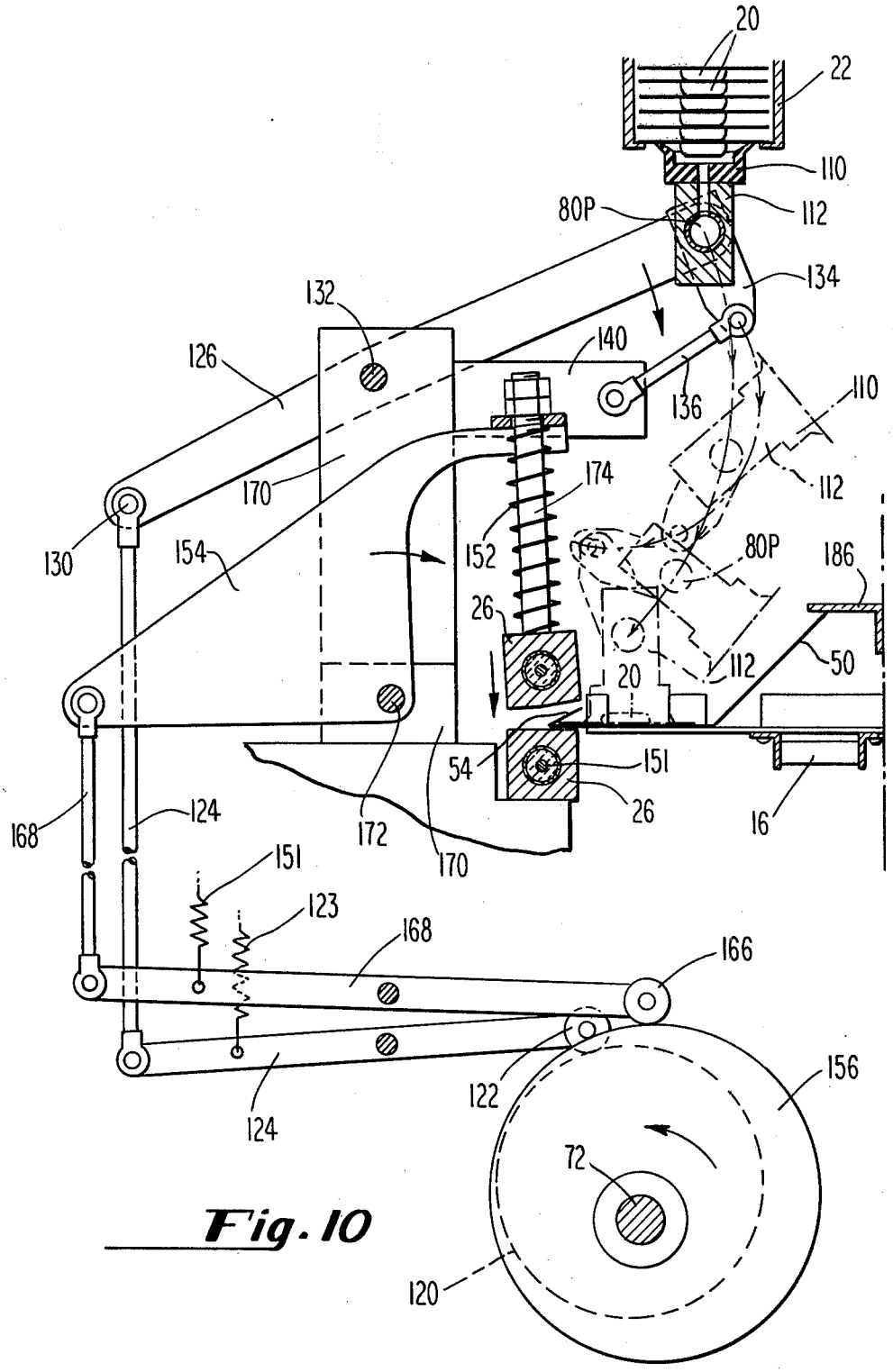

A filled blister pack 20 is simultaneously withdrawn from each blister pack compartment by a pair of suction cups 110 mounted to a vacuum manifold block 112 (FIG. 10).

Figure 2:
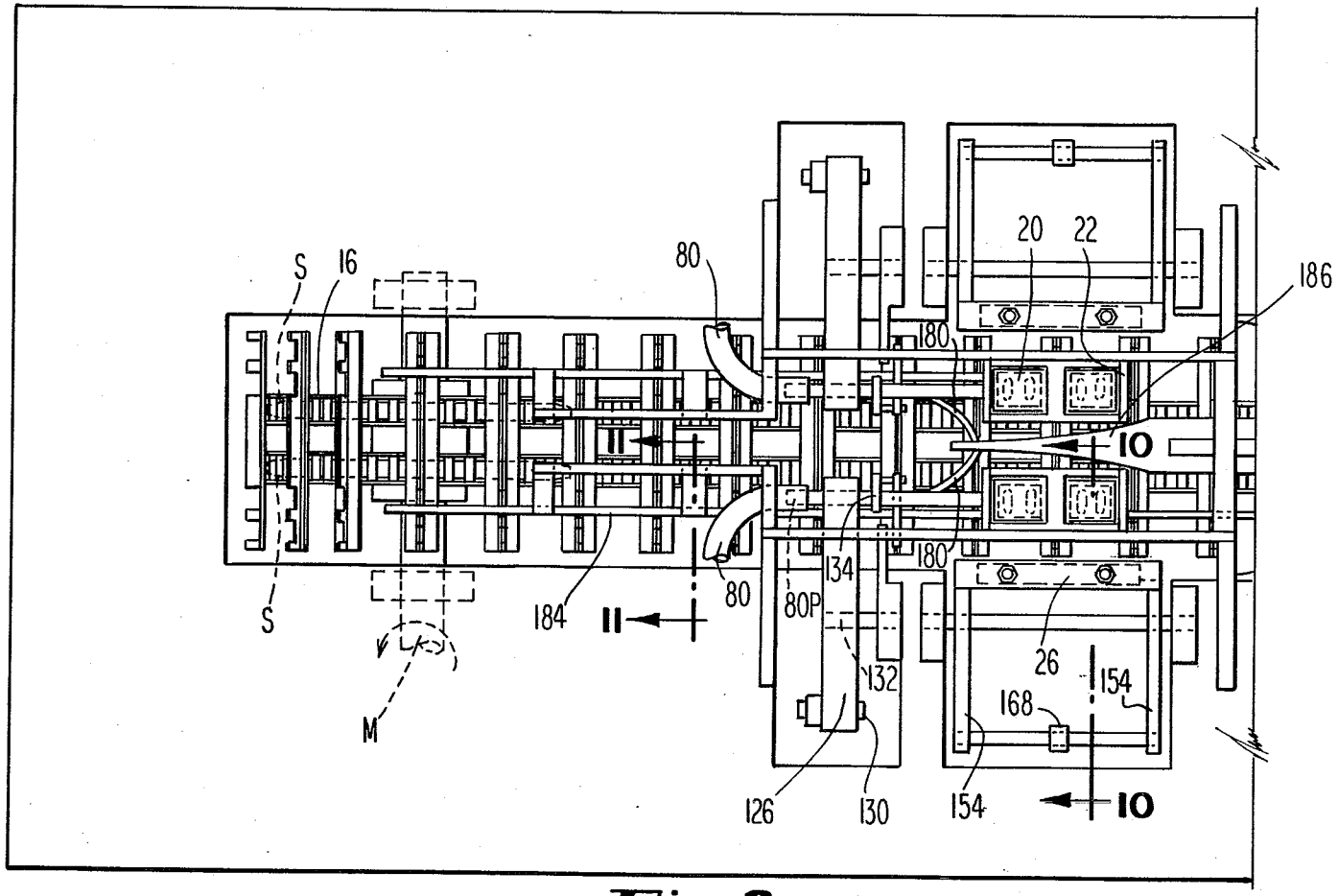

Vacuum manifold block 112 is connected to vacuum line 80 by a non-flexible tubular vacuum pipe 80P inserted therein (FIGS. 2 and 10). As aforediscussed, U shaped pivot suction arm 66 is also connected to vacuum. Suction is applied substantially alternately between suction cups 86 and suction cups 110.

Each suction cup 110 contacts an inverted filled blister pack 20 to withdraw one from each compartment of blister pack magazine 22. More specifically, cam 120, secured to cam shaft 72, causes follower 122 to follow the slope on cam 120 by virtue of tension spring 123 to thereby move linkage members 124 which causes linking arm 126 to pivot about pivot points 130 and 132. Pivot point 132 pivots on a suitable frame support member 170. A lever arm 134 is pivotally mounted between vacuum manifold block 112 and linking arm 126 by means of suction pipe 80P. As shown clearly in FIG. 10, a connecting link 136 is pivotally connected to a lower end of lever arm 134, the other end of connecting link 136 being similarly connected to a mounting block arm 140 secured to frame support member 170, both of the pivot connections for connecting link 136 being suitably ball joint pivots.

Withdrawing the blister packs 20 for insertion into the open match book covers is governed by the cooperating motions of linkage members 124, linking arm 126, lever arm 134 and connecting link 136, which cause vacuum manifold block 112 to initially descend substantially vertically. After the withdrawn blister packs 20 have sufficiently cleared the blister pack magazine 22, the inverted blister packs are rotated in a downward arcuate motion in a direction transverse to the axis of the machine such that the capsules contained within the blister packs are inserted right-side-up, adjacent to or against the fold formed by the sealing flap and back cover, in one smooth motion. Vacuum line 80 is flexible (FIG. 2) to permit the blister packs to be thus inserted with freedom of motion.

Simultaneously with the insertion of blister packs 20 into the open match book covers 14 (FIG. 3E), sealing jaws 26, positioned to clamp the sealing flap end of the loaded match book covers, suddenly close to seal the blister packs therein (FIG. 3F). Clamping surfaces of jaws 26 are serrated. Jaws 26 contain conventional electric resistance elements 150 therein which maintain the jaws at an appropriate heat sealing temperature. As aforediscussed, match book covers 14 are pretreated or coated with a suitable heat-sealing composition. Jaws 26 are caused to suddenly clamp together when cam 156, also secured to cam shaft 72, causes linkage members 168 to move in response to movement of follower 166 on cam 156. Jaw support arm 154, pivotally mounted to end of linkage member 168 is caused to pivot clockwise (FIG. 10) by virtue of tension spring 151 urging follower 166 to follow slope on cam 156. Linkages 168 provide an overtravel for the sealing jaws to thus cause a compression spring 152, mounted on rod 174 which interconnects the upper jaw member to jaw support arm 154, to be further compressed. Varying the preset tension on spring 152 provides means for adjusting jaw pressure. Jaw support arm 154 is pivotally mounted to frame support member 170 at 172. Cam 156 is provided with a no-actuation dwell, as is cam 70 aforediscussed, which coincides with that part of the cycle when chain 16 is advancing. The slope on cam 156 which produces the motions aforedescribed occupy substantially the remaining 180° thereon, i.e., when chain 16 is stationary. Of course, an oppositely sloped surface on cam 156 causes the jaw support arm to rotate in a counter-clockwise direction to thereby unclamp the jaws after the jaws have heat and pressure sealed the blister packs into the match book covers (FIG. 3F).

Suction is withdrawn immediately after the insertion of the blister packs into the open match book covers in order to prevent the blister packs being withdrawn therefrom. More specifically, as soon as chain 16 stops advancing, suction cups 110 deposit the blister packs into the opened match book covers and suction is immediately switched to suction cups 86 by means of a commercially available 4-way valve controlled by a solenoid energized cam operated switch. At that moment, suction cups 86 are pivoting upwardly to withdraw the empty folded covers. Suction cups 86 then pivot downwardly to deposit the covers on the flights just prior to chain 16 starting its advance. At that moment suction is again transferred by means of the 4-way valve from cups 86 to release the covers, back to cups 110 which are now approaching the blister packs in the magazines. The blister packs are then inserted into the covers as soon as chain 16 stops advancing and the cycle repeated.

The loaded match book covers next encounter a converging rail 180 (FIGS. 2, 3G, 3H, 11 and 12) which gradually folds front cover 50 over the sealed and loaded blister pack prior to packaging thereof by conventional means. Converging rail 180 is not shown in FIG. 10 for purposes of clarity.

A back cover hold-down rail 184 (FIGS. 2 and 9), connected to converging rail 180, maintains back cover 52 substantially flat while front cover 50 is being folded by the converging rail. Ramp 92 leads into a tapered front cover hold-down rail 186 (FIGS. 2, 10, 11 and 12) which prevents front cover 50 from closing during insertion of a blister pack 20 into the opened match book cover.

It is apparent from the aforegoing description that movement of chain 16 is not continuous, but is continuously uniformly interrupted in order that match book covers 14 may be deposited from chutes 12 onto flights 30. Synchronized therewith, blister packs 20 are withdrawn from magazines 22 while chain 16 is in motion in order that the blister packs may be positioned in the open match book covers 14 at the earliest possible moment after chain 16 stops movement and immediately prior to clamping shut of the sealing jaws. Cam 120 (FIG. 10) is not restricted in its timing by the 180° advancing cycle of chain 16, since none of the members actuated by cam 120, i.e., linking members 124, linking arm 126, lever 134, etc., conflict with the path of movement of chain 16. In view thereof, the slopes of cam 120 are configured to place the blister packs into position within the opened match book covers just as soon as the covers, carried by chain 16, comes to rest, thus permitting the longest possible sealing cycle.

The various cams, i.e., cam 70, 120 and 152, associated respectively with U-shaped pivot suction arm 56, withdrawal of blister packs 20 from magazines 22, and the clamping and unclamping of jaws 26, are all adjustably secured to the single cam shaft 72. The cams may readily be synchronized by merely adjustably rotating any or all on the cam shaft.

The cam surface configurations are not shown or described since one skilled in the art may design slopes and dwells in accordance with functions to be performed and times for their performance by computer or trial and error.

Connections for the vacuum pump, motor for driving the sprockets, limit switches, and the like, are conventional and are not shown or described.

Synchronization of the vacuum operations may readily be achieved through the use of conventional limit switches cooperating with commercially available solenoid valves, and are also not shown or described. Photoelectric cells may optionally be mounted to the machine at desired locations to stop the machine in the interest of safety or quality control for any predetermined reason.

It is appreciated that chutes 12 and magazines 22 may include more than a pair of compartments therein such that three or more folded match book covers 14 and blister packs 20 may respectively be withdrawn simultaneously therefrom. Of course, the remaining structure may require modification to accommodate these added quantities.

I claim:

1. Machine for automatically loading articles into covers comprising endless conveyor means, means for moving and interrupting movement of said conveyor means, feeder means containing said covers in a folded condition mounted at one end of said machine, means for withdrawing said folded covers from said feeder means for depositing said folded covers for transport with said conveyor means, means for opening said folded covers, magazine means mounted at other end of said machine for containing said articles, means for withdrawing said articles from said magazine means, means for inserting said withdrawn articles into said opened covers, means for folding said covers over said inserted articles to secure said articles therewithin, and other means for synchronizing said means for withdrawing said folded covers and means for withdrawing said articles with said means for moving and interrupting movement of said conveyor means, and additional means cooperating with said means for withdrawing said articles from said magazine means and insertion means for heat-sealing said articles into said opened covers.

2. Machine of claim 1 wherein said folded covers comprise match book-like covers having a front cover folded over a back cover, and a short sealing flap extending from said back cover folded back between said covers.

3. Machine of claim 3 further characterized by said conveyor means carrying uniformly spaced pairs of flights transversely thereacross, said flight pairs each comprising a pair of flights in spaced back-to-back relationship, each of said flights including a vertical portion, and a horizontal portion integral therewith, each of said flights being separately secured to said conveyor means, and each of said pairs of flights being spaced from another by a distance substantially equal to width of said covers, each succeeding folded cover being deposited on succeeding facing horizontal strips of adjacent flight pairs.

4. Machine of claim 3 wherein said feeder means and said magazine means comprise an equal number of a plurality of adjacent compartments in tandem for respectively simultaneously feeding said folded covers and said articles therefrom for additional processing downstream.

5. Machine of claim 4 wherein said feeder means and said magazine means comprise a pair of compartments in tandem.

6. Machine of claim 5 wherein said feeder means and said magazine means are provided at both sides of said machine to thereby double its production capabilities.

7. Machine of claim 5 wherein said articles are blister packs of pharmaceutical capsules.

8. Machine of claim 7 wherein said folded covers are pre-coated on interior surfaces thereof with a heat sealing composition.

9. Machine of claim 8 wherein said heat-sealing means comprises jaws which heat seal said blister packs into said covers with a sudden clamping motion substantially simultaneously with insertion of said blister packs thereinto.

10. Machine of claim 9 wherein said jaws are serrated on clamping surfaces thereof and are heated by electric elements contained therewithin.

11. Machine of claim 4 wherein said means for withdrawing said folded covers from said feeder means comprise a U-shaped suction pivot arm mounted to said machine below said feeder means, said pivot arm including a pair of legs having suction cups mounted thereto, means for rotating a cam shaft, a first cam mounted to said cam shaft, a first follower means moving in response to rotation of said first cam, first linkage means articulating between said first follower means and U-shaped suction pivot arm, means for applying a vacuum to said U-shaped pivot suction arm and suction cups whereby said means for interrupting movement of said conveyor means is synchronized with rotation of said first cam to thereby pivot said legs of said suction arm through adjacent spaces provided between flight pairs for simultaneously withdrawing folded covers from said feeder means for depositing said folded covers in adjacent flight pairs.

12. Machine of claim 11 wherein means for opening said folded covers during downstream transport thereof comprises a deflector member for deflecting downwardly sealing flap end of said match book like cover, a ramp immediately downstream said deflector for sliding under said front cover for unfolding thereof, a depressor further downstream an upstream end of said ramp for separating said sealing flap from said back cover, and a guide rail further downstream said depressor for opening said sealing flap to an angle less than 90° with said back cover.

13. Machine of claim 12 further characterized by said ramp extending downstream said guide rail and configured for opening said front cover sufficiently for insertion into said match book-like covers of said withdrawn articles.

14. Machine of claim 13 further characterized by the presence of a hold-down bar secured to said machine slightly upstream of said deflector and extending downstream at least several widths of said match book-like covers.

15. Machine of claim 13 wherein said articles are blister packs loaded into said magazine means inverted and said means for withdrawing said inverted blister packs comprise a vacuum manifold block mounted below said magazine means, said vacuum manifold block having a pair of spaced suction members provided thereabove, a second cam mounted to said cam shaft, a second follower means moving in response to rotation of said second cam, linking means articulating between said second follower means and said vacuum manifold block whereby said pivoting of said U-shaped pivot suction arm is synchronized with said withdrawal movement of said inverted blister packs by said suction members.

16. Machine of claim 15 wherein said withdrawn inverted blister packs are inserted into said opened match book-like covers right side up by means comprising a linking arm articulating with said linking means, a lever arm articulating with said linking arm, a connecting link pivotally mounted between a lower end of said lever arm and a mounting block arm secured to a frame member of said machine, means responsive to rotation of said second cam for causing said vacuum manifold block to descend substantially vertically with said inverted blister packs such that said inverted blister packs clear said magazine means and are rotated downwardly arcuately by said lever arm and connecting link to thereby insert said blister packs right-side-up into said opened match book-like covers.

17. Machine of claim 16 wherein said loaded and heat-sealed match book-like covers are contacted by a converging rail member to fold said front cover over the sealed blister pack.

18. Machine of claim 17 wherein said means for withdrawing said folded match book-like covers are synchronized with:

(a) said means for withdrawing said blister packs and insertion thereof into said opened match book-like covers, and (b) said means for heat-sealing said inserted articles into said opened match book-like covers.

19. Machine of claim 17 wherein a tapered front cover hold-down rail at a downstream portion of said ramp maintains said front cover opened during insertion of said blister pack into said opened match book-like cover.

20. Machine of claim 19 wherein a back cover hold-down rail at a downstream portion of said converging rail maintains said back cover substantially flat while said front cover is being folded by said converging rail.

21. Machine of claim 18 wherein separate cams are provided for each of the means for providing said synchronizations.

22. Machine of claim 21 wherein each of said separate cams is secured to a single continuously rotating cam shaft.

* * * * *